US006352379B2

(12) United States Patent
Sanada

(10) Patent No.: US 6,352,379 B2
(45) Date of Patent: Mar. 5, 2002

(54) DEVELOPING DEVICE AND PHOTOSENSITIVE MATERIAL PROCESSING METHOD

(75) Inventor: Kazuo Sanada, Sendai (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/727,767

(22) Filed: Dec. 4, 2000

(30) Foreign Application Priority Data

Dec. 2, 1999 (JP) ..... 11-343562

(51) Int. Cl.[7] ..... G03D 13/00; B24B 7/00

(52) U.S. Cl. ..... 396/575; 241/101.2; 241/34; 451/28; 399/1

(58) Field of Search ..... 396/564, 575; 399/1, 367; 355/27–29, 77; 241/101.2, 34, 100, 236; 101/142; 451/38, 182, 28; 358/401

(56) References Cited

U.S. PATENT DOCUMENTS 4,134,341 A * 1/1979 Weigele et al. ..... 101/142
4,201,015 A * 5/1980 Reim ..... 451/182
4,561,765 A * 12/1985 Masuda ..... 399/367
4,941,290 A * 7/1990 Holyoke ..... 451/182
5,003,405 A * 3/1991 Wulforst ..... 241/101.2
5,354,001 A * 10/1994 Hasegawa ..... 241/34
5,666,191 A * 9/1997 Hasegawa et al. ..... 399/366
6,203,603 B1 * 3/2001 Takayama et al. ..... 106/31.16

FOREIGN PATENT DOCUMENTS

FR 2764628 A * 12/1998

* cited by examiner

*Primary Examiner*—D Rutledge
(74) *Attorney, Agent, or Firm*—Sughrue Mion, PLLC

(57) ABSTRACT

A developing device in which, after a film onto which an image was exposed has been heat-development processed, an image reader reads image information from the film and the image information is recorded onto a floppy disk. Then the film from which the image information was read is transported to a cutting apparatus. At the cutting apparatus, the film is grippedly transported between a cutter roller and a rubber roller and the film is destroyed such that the image information thereon cannot be read. The cutting apparatus is built into the interior of the developing device. Thus, when the film is ejected to an eject tray provided outside the developing device, the image information is already in an indecipherable state. Hence, the confidentiality of the recorded image information is reliably assured.

31 Claims, 6 Drawing Sheets

DEVELOPING DEVICE AND PHOTOSENSITIVE MATERIAL PROCESSING METHOD

BACKGROUND OF THE INVENTION

1. Field of the Invention

The present invention relates to a developing device for heat-development processing of a photosensitive material onto which an image has been exposed.

2. Description of the Related Art

Conventional print processing systems had the capability of long-term storage of an image on a developed photographic film. Thus, even after the image had been printed on a print, this capability served as a memory for storing primary data and was used during reprinting.

In some developing devices, an exposed photographic film is coated with an image-formation processing solution, water, at a coating apparatus, then superposed with a developing member containing an image-forming chemical, wound around a heating drum and heat-processed for a predetermined duration. Then the photographic film and the developing member are peeled apart. As a result, the film's image is made into a visible image.

In such a developing device, development processing is completed before chemical reaction processes have come to a complete stop. Therefore, chemical reactions may gradually proceed during storage of the developed photographic film. Thus, the film does not have long-term storageability. Consequently, there is a need for image information on the photographic film to be read and recorded at a separate recording means.

On the other hand, in such a heat-developing device, the image information on the photographic film does not necessarily vanish immediately after the image information has been read; the image may gradually alter and disappear over a period of several days or weeks. Therefore, some measures have to be taken in order to prevent the image information on the photographic film from being read again and duplicated, so that confidentiality (uniqueness) of image information recorded at the recording means is guaranteed.

SUMMARY OF THE INVENTION

The present invention is provided to solve the above-described problem and an object of the present invention is to guarantee confidentiality (uniqueness) of image information recorded at a recording means, by destroying photographic film of which image information has been read.

A first aspect of the present invention is a device for developing photosensitive material on which an image has been exposed, the device including: (a) a developing apparatus for performing heat-development processing of the photosensitive material; (b) an image reader disposed for receiving the photosensitive material from the developing apparatus and reading an image thereon, the image reader producing electronic image information corresponding to the read image; (c) an information recording apparatus which receives the electronic image information from the image reader and records the electronic image information; and (d) an image destroying apparatus disposed for receiving the photosensitive material from the image reader, and destroying the image.

In this aspect, the image information of the photosensitive material from which the image information has been read is destroyed. Thus, the confidentiality of the image information is reliably assured.

A second aspect of the present invention is the invention of the first aspect, wherein the image destroying apparatus completes destruction of the image before the photosensitive material is ejected outside the device. That is, reproducible primary data is destroyed before being made available to a person. Thus, the confidentiality of the image is reliably assured.

A third aspect of the present invention is the invention of the first aspect, wherein the information recording apparatus, when recording the electronic image information, marks the recorded electronic image information for indicating that the information is primary data. Consequently, it can be confirmed that the electronic image information is designated as a master.

A fourth aspect of the present invention is the invention of the first aspect, wherein the image destroying apparatus includes a light-flashing apparatus which produces a flash for destroying the image. The photosensitive material is illuminated with strong light with this flashing apparatus, so that silver halide blackens and becomes fogged and the image is destroyed.

A fifth aspect of the present invention is the invention of the first aspect, wherein the image destroying apparatus includes a container for holding a liquid. For example, the photosensitive material is dipped in an alkali solution bath and pigments that form the image are eluted, thereby destroying the image.

A sixth aspect of the present invention is the invention of the first aspect, wherein the image destroying apparatus includes a cutter for destroying the image. For example, the photosensitive material is cut by a cutting apparatus such as a shredder or the like, thereby destroying the photosensitive material image information.

A seventh aspect of the present invention is the invention of the first aspect, wherein the image destroying apparatus includes a rasp for destroying the image. For example, a file or the like scratches the surface of the photosensitive material, thereby destroying the image.

An eighth aspect of the present invention is the invention of the first aspect, wherein the image destroying apparatus includes a perforator for destroying the image. For example, awls or the like make a plurality of holes penetrating the photosensitive material, thereby destroying the image.

A ninth aspect of the present invention is a method of processing exposed photosensitive material, including the steps of: producing a visible image by heat-development processing of the exposed photosensitive material; reading and recording the visible image as image data; and destroying the visible image on the photosensitive material from which the visible image has been read and recorded as image data.

DESCRIPTION OF THE PREFERRED EMBODIMENTS

Figure 1:
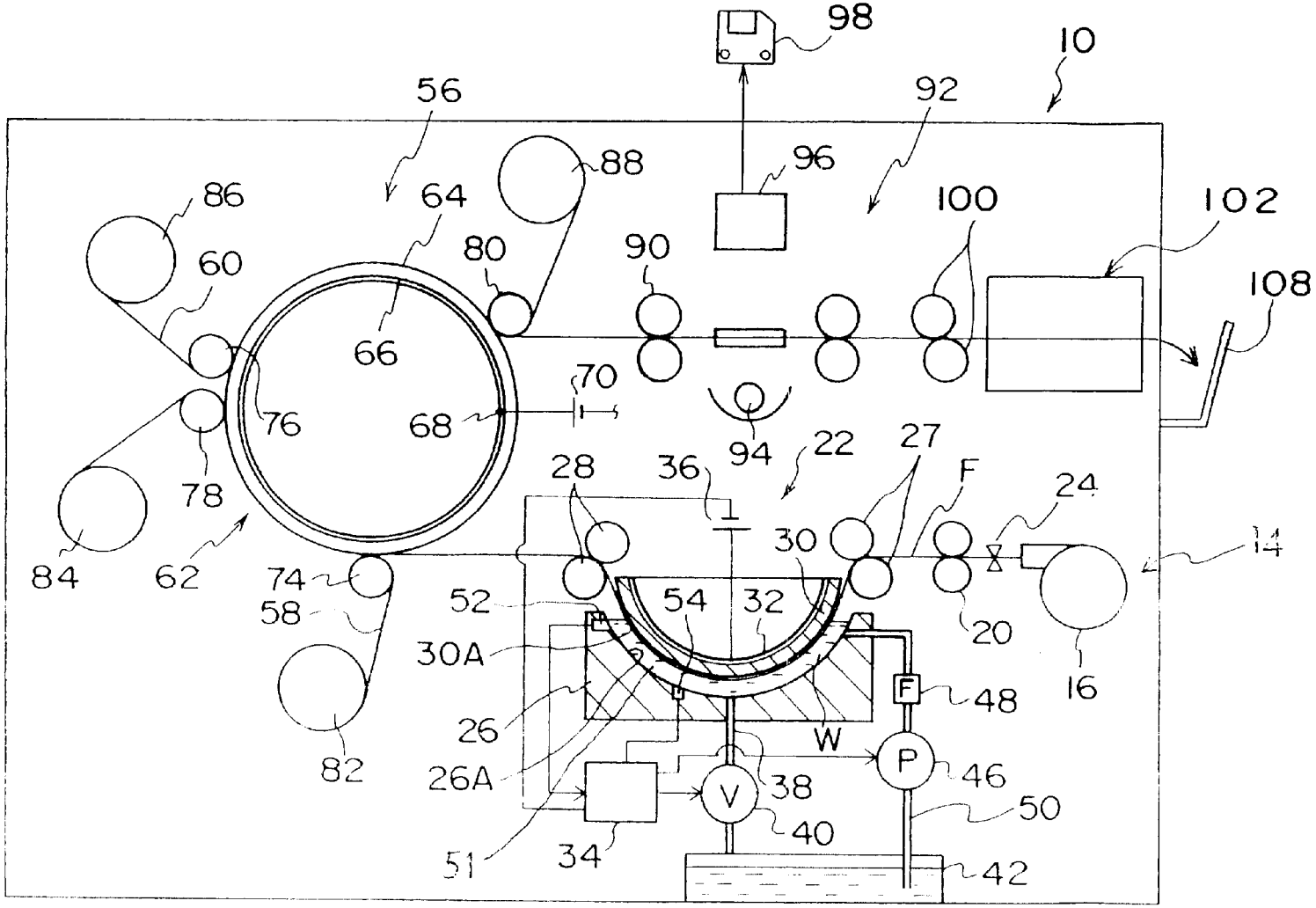
FIG. 1 is a structural diagram of a developing device according to one embodiment of the present invention.

As shown in FIG. 1, a cartridge loading portion 14, at which a cartridge 16 accommodating an exposed film is loaded, is provided at a casing of a developing device 10 according to one embodiment of the present invention. A shading door is provided at this cartridge loading portion 14. The shading door is closed when a cartridge is loaded, and shades the interior of the cartridge loading portion 14.

A film F is unwound from the cartridge 16 loaded in the cartridge loading portion 14 and is transported by transport rollers 20 to a coating apparatus 22. A cutter 24 or (in the case of APS) a detacher for separating the film F from a winding core is disposed at an upstream side of the transport rollers 20 and cuts a back end portion of the film F from the cartridge 16.

The coating apparatus 22 is provided with a coating tank 26 having a bowl-shaped water reservoir portion 51 whose bottom surface is curved along a transport path of the film F. A pair of feed rollers 27 are disposed at an upstream side of the coating tank 26 and squeeze rollers 28 are disposed at a downstream side of the coating tank 26. The feed rollers 27 feed the film F to the coating tank 26 and the squeeze rollers 28 squeeze off surplus water from the film F which has been coated with water W.

A heat exchange block 30 in a half-pipe shape is supported at the upper side of the water reservoir portion 51. The heat exchange block 30 is produced by press-machining an aluminum member, leading to reduced manufacturing costs. The heat exchange block 30 is cut away except at side walls such that a peripheral wall 30A, which is immersed in the water W stored in the water reservoir portion 51, is a thin wall. An arc-shaped gap between the peripheral wall 30A of the heat exchange block 30 and a bottom surface 26A of the coating tank 26 (in the present embodiment this gap is set at 2 mm) is a transit portion for the film F.

A surface heater 32 is curvedly installed at a rear side of the peripheral wall 30A of the heat exchange block 30. Electric power from a power supply portion 36 connected to a controller 34 is applied to the surface heater 32, which heats the heat exchange block 30.

Because the peripheral wall 30A immersed in the water W is a thin wall, heat capacity of the heat exchange block 30 can be made lower. Thus, temperature of the heat exchange block 30 increases quickly and temperature of the water W can be increased in a short time. Further, because the surface heater 32 is installed at the rear side of the peripheral wall 30A, and the separation gap between the surface heater 32 and the water W is made small, heat transfer efficiency is improved and power consumption can be reduced.

A drainage pipe 38 is connected to the bottom surface 26A of the coating tank 26. A solenoid valve 40 is disposed at the drainage pipe 38. The solenoid valve 40 is usually (when the developing device is on standby) in an open state, and the water W of (the water reservoir portion 51 of) the coating tank 26 drains through the drainage pipe 38 to a tank 42. Thus, occurrence of scaling and proliferation of germs inside the water reservoir portion 51 can be prevented. Hence, image quality of the film F that is to be heat-development processed can be assured. Water squeezed off by the squeeze rollers 28 is supplied to the tank 42 via an unillustrated receiving dish.

The water W of the tank 42 is supplied to the coating tank 26 by a water supply pipe 50 having a pump 46 and a filter 48 provided at an intermediate portion thereof.

The pump 46 is connected to the controller 34 and delivery amounts and delivery timings are controlled thereby. Moreover, a water level sensor 52, which detects the water level in the coating tank 26, and a temperature sensor 54, which detects the temperature of the water W in the coating tank 26, are connected to the controller 34. On the basis of detection results from the water level sensor 52 and the temperature sensor 54, the pump 46 is driven so as to maintain a specified water level and voltage applied to the surface heater 32 by the power supply portion 36 is controlled so as to adjust the temperature of the water W to a specified temperature (about 40° C.).

Therefore, providing an overflow tank at the coating tank 26 to control the water level is not necessary. Thus, there is no need for temperature adjustment of any water that is not required for coating. Consequently, the amount of water stored in the coating tank 26 is reduced and the water's temperature can be adjusted in a short time. Further, because the water's temperature is detected directly, accurate temperature adjustment is possible.

The film F that has been coated with water at the coating apparatus 22 is transported to a heat-development processing section 56. A first processing sheet 58 and a second processing sheet 60, which include chemicals, are sequentially superposed on the film F. The film F and the first and second processing sheets 58, 60 superposed thereon are wound around a heating drum 62 and are heat-development processed.

The heating drum 62 is provided with an aluminum ring body 64 having a predetermined axial length. A surface heater 66 is attached to and directly heats an inner circumferential surface of the ring body 64. A power feed portion 68 for the surface heater 66 protrudes in the radial direction of the ring body 64, and is electrically connected to a slip ring which is disposed coaxially with the ring body 64. Voltage from a power supply portion 70, which is connected to the controller 34, is applied to the slip ring. Thus, the ring body 64 can be heated while rotating to match the transport speed of the film F.

Further, unlike conventional heating drums, both axial direction ends of the ring body 64 are not enclosed by flanges. Thus, the heat capacity of the heating drum 62 can be lowered. Consequently, the time taken to raise the temperature of the ring body 64 can be shortened. Further, the inner circumferential surface of the ring body 64, around which the film F is wound, is directly heated by the surface heater 66. Therefore, heat transfer efficiency is good and the temperature can be raised to a specified temperature in a short time.

An outer circumferential surface of the ring body 64 is rotatably supported at a first laminating roller 74, a first peeling roller 78, a second laminating roller 76 and a second peeling roller 80. At the first laminating roller 74, the first processing sheet 58 is wound on a first supply reel 82 in the form of a roll. The first processing sheet 58 winds around the outer circumferential surface of the ring body 64, winds around the first peeling roller 78, and is taken up by a first take-up reel 84.

Further, at the second laminating roller 76, the second processing sheet 60 is wound on a second supply reel 86 in the form of a roll. The second processing sheet 60 winds around the outer circumferential surface of the ring body 64, winds around the second peeling roller 80, and is taken up by a second take-up reel 88.

In such a structure, the ring body 64 is rotated by the first laminating roller 74, the first peeling roller 78, the second laminating roller 76 and the second peeling roller 80, which are rotated by an unillustrated driving apparatus. In addition, the ring body 64 is rotated at a peripheral velocity the same as the transport speed of the first processing sheet 58 and the second processing sheet 60.

Hence, first, the film F is laminated with the first processing sheet 58 at the first laminating roller 74 and heated for a predetermined period of time while moving in conjunction with the ring body 64. Then, the film F is laminated with the second processing sheet 60 at the second laminating roller 76, heated for a predetermined period of time while moving in conjunction with the ring body 64, and peeled from the second processing sheet 60 at the second peeling roller 80. Thus, a latent image is made into a visible image.

The film F which has been peeled from the heating drum 62 is transported to an image reading section 92 by transport rollers 90. A light source 94 is disposed at the image reading section 92 and is used for illumination during image reading.

A reading portion 96, which is provided with a lens and a CCD sensor, is provided above the light source 94 with the film F therebetween. Image information of the film F is recorded on a floppy disk 98 as digital image data. A flag is then set to show that the image data on the floppy disk 98 is primary data. Consequently, it can be confirmed that the floppy disk 98 is designated as a master disk. Any common medium, such as a rewritable optical disk or a magneto-optical disk, can be used in place of the floppy disk.

Next, the film F whose image data has been read is transported by transport rollers 100 to a cutting apparatus 102. At the cutting apparatus 102, a cutter roller 104 and a rubber roller 106 are provided. A plurality of ring-shaped blades 104A are attached to an outer circumferential surface of the cutter roller 104 along the axial direction thereof.

The film F is grippedly transported and cut into narrow strips by the cutter roller 104 and the rubber roller 106, which are turned by an unillustrated drive motor. In short, the film F is destroyed such that the image information cannot be read. It should be noted that the cutting apparatus 102 is built into the developing device 10. Therefore, when the film F is ejected to an eject tray 108, which is provided outside the developing device 10, the image information is already in an indecipherable state. Hence, the confidentiality of the image information is reliably assured.

Figure 2:
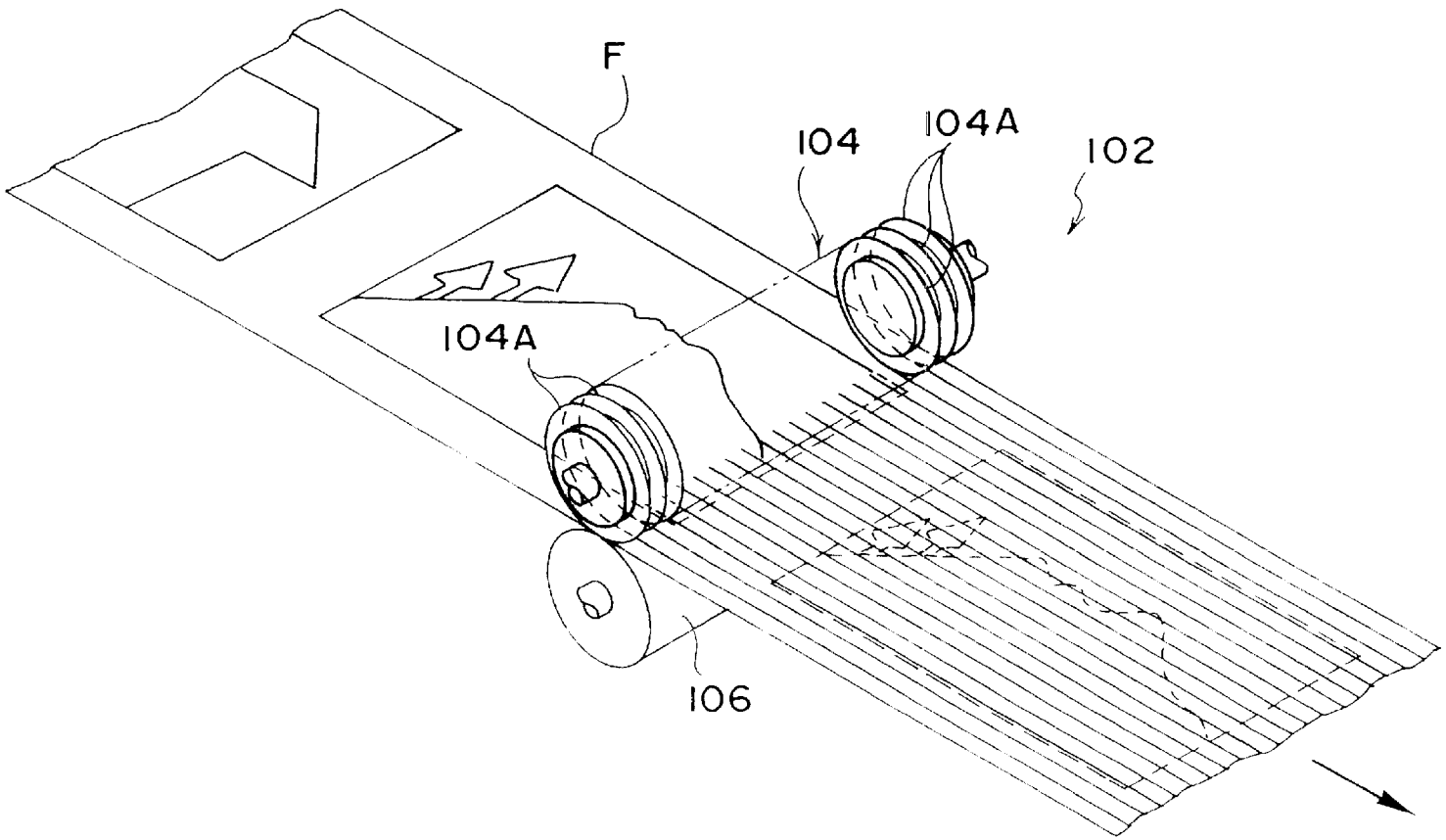
FIG. 2 is a perspective view showing a cutting apparatus disposed in the developing device according to the one embodiment of the present invention.
Figure 3:
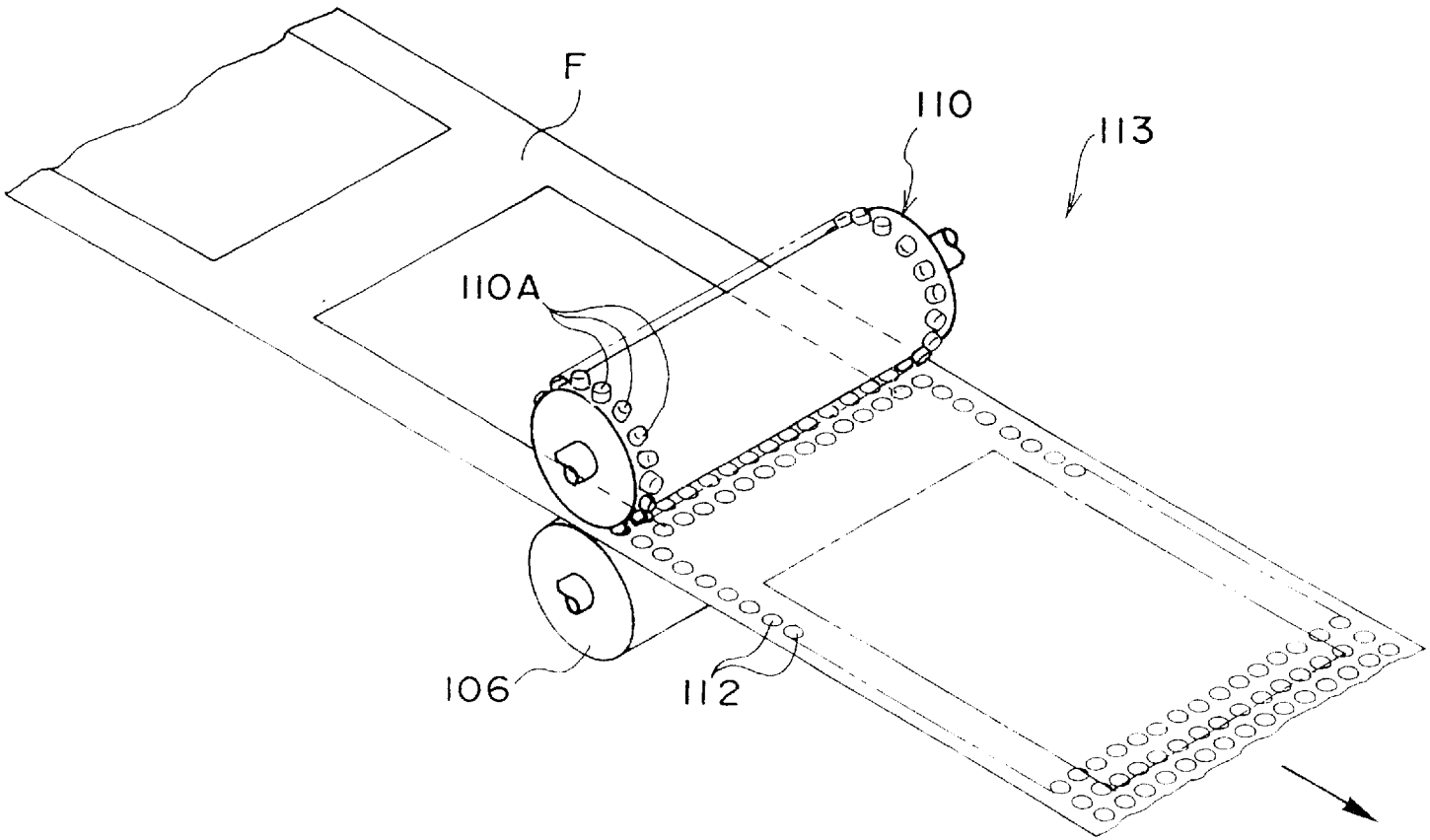
FIG. 3 is a perspective view showing a perforating apparatus disposed in the developing device according to the one embodiment of the present invention.

A modified example of the present embodiment may have, instead of the cutting apparatus shown in FIG. 2, a perforating apparatus 113 as shown in FIG. 3. The perforating apparatus 113 is formed by a punching roller 110, from an outer circumferential surface of which a plurality of pins 11OA for punching protrude, and the rubber roller 106. A plurality of holes 112 penetrate the film F and the image information is destroyed by the perforating apparatus 113.

Figure 4:
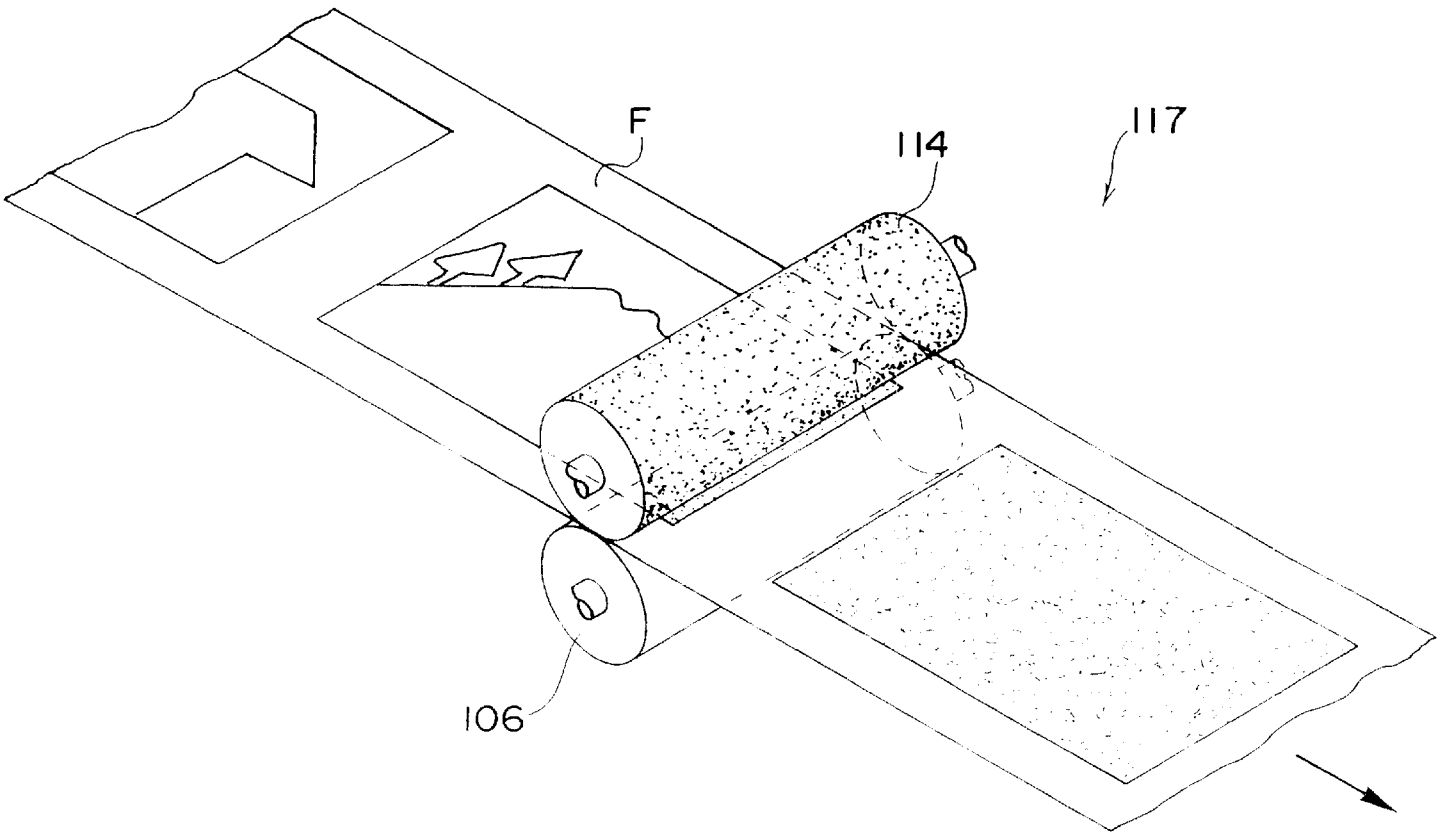
FIG. 4 is a perspective view showing a rasping apparatus disposed in the developing device according to the one embodiment of the present invention.

Another modified example of the present embodiment may have a rasping apparatus 117 as shown in FIG. 4. The rasping apparatus 117 is formed by a file roller 114, which has a rough outer circumferential surface, and the rubber roller 106. The rasping apparatus 117 shaves the surface of the film F in an irregular fashion and destroys the image information.

Figure 5:
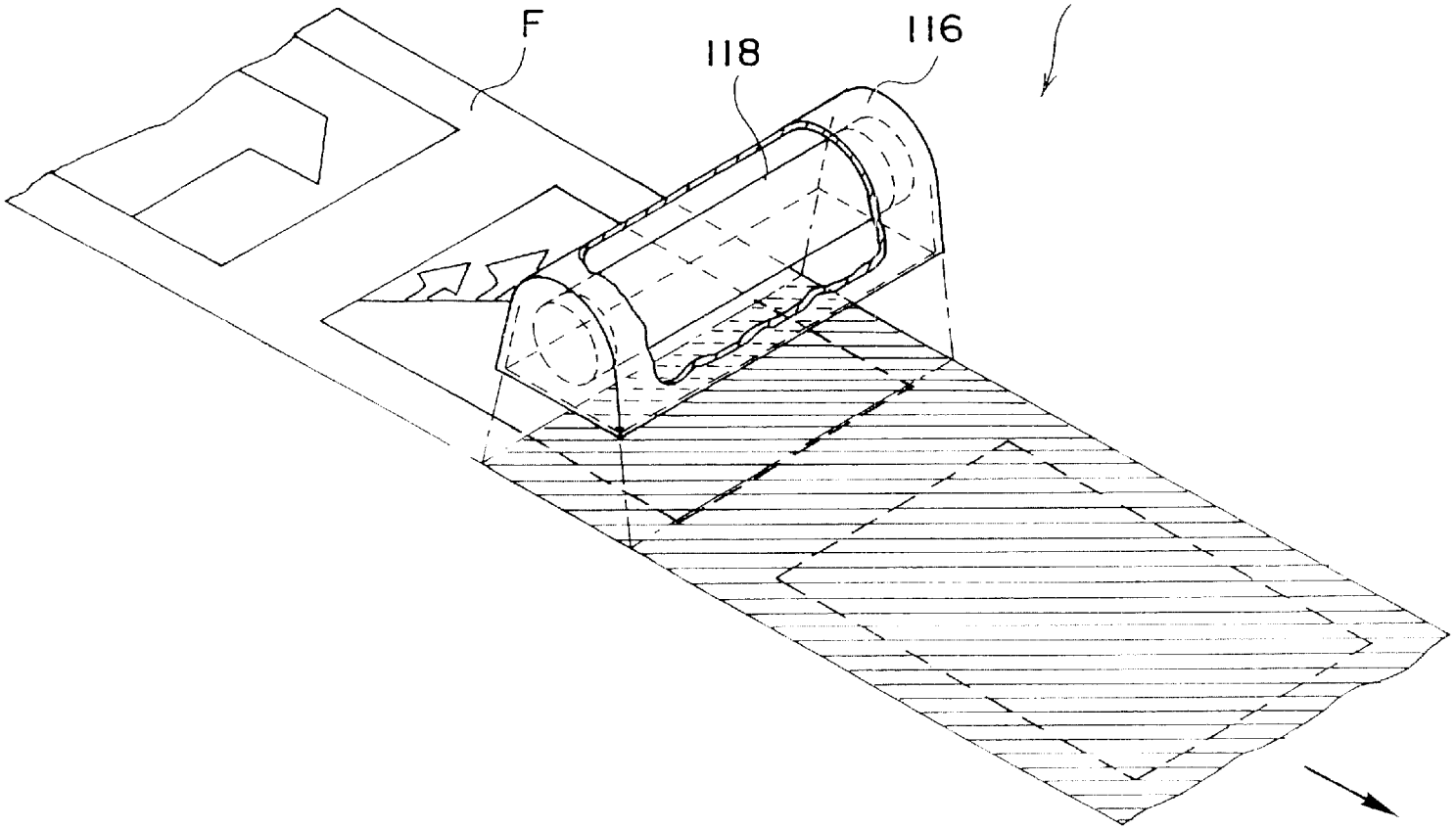
FIG. 5 is a perspective view showing a flashing apparatus disposed in the developing device according to the one embodiment of the present invention.

Yet another modified example of the present embodiment may have a light-flashing apparatus 119 as shown in FIG. 5. The light-flashing apparatus 119 is formed by a reflector 116 and a strong light source 118 (e.g. a heat lamp). The film F is illuminated with strong light by the light-flashing apparatus 119, causing silver halide to blacken and fog up the film F. The image information is thus destroyed.

Figure 6:
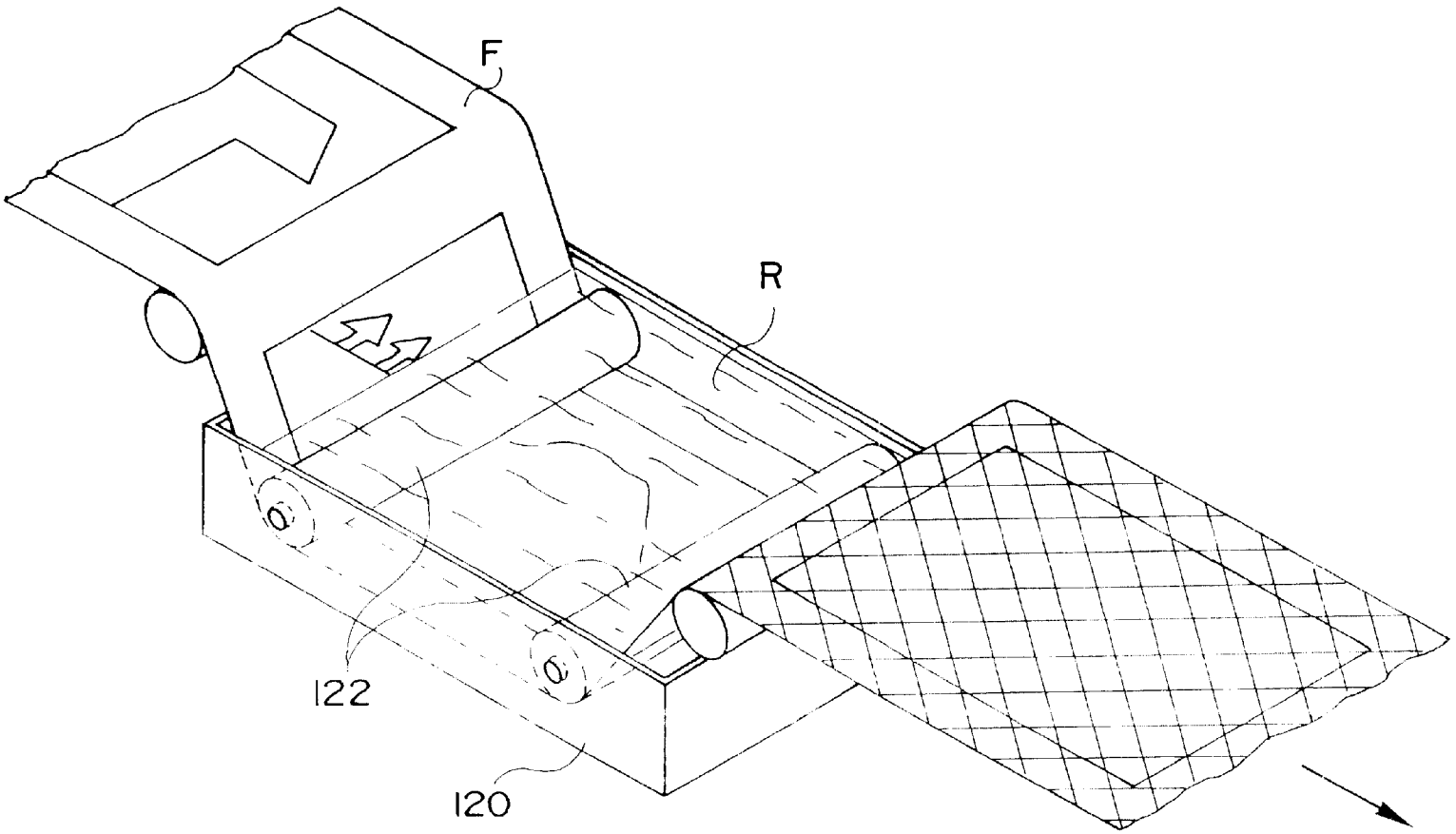
FIG. 6 is a perspective view showing a liquid container disposed in the developing device according to the one embodiment of the present invention.

Yet another modified example of the present embodiment may have a liquid container 120 holding an alkali solution, such as a caustic soda solution R, as shown in FIG. 6. The film F is immersed by rollers 122, pigments that form the image are eluted, and the image information is destroyed.

In short, in the present invention, films of which image information has been read are destroyed by the above-described structures. Thus, confidentiality (uniqueness) of image information recorded on a recording member is assured.

What is claimed is:

1. A device for developing photosensitive material on which an image has been exposed, the device comprising:

(a) a developing apparatus for performing heat-development processing of the photosensitive material;

(b) an image reader disposed for receiving the photosensitive material from the developing apparatus and reading an image thereon, the image reader producing electronic image information corresponding to the read image;

(c) an information recording apparatus which receives the electronic image information from the image reader and records the electronic image information; and (d) an image destroying apparatus disposed for receiving the photosensitive material from the image reader, and destroying the image.

2. The device of claim 1, further comprising a housing, which accommodates therein at least the developing apparatus, the image reader, and the image destroying apparatus.

3. The device of claim 2, wherein the image destroying apparatus completes destruction of the image within the housing.

4. The device of claim 3, wherein the image destroying apparatus employs a chemical process when destroying the image.

5. The device of claim 3, wherein the image destroying apparatus physically destroys the image.

6. The device of claim 4, wherein the image destroying apparatus includes a light-flashing apparatus which produces a flash for destroying the image.

7. The device of claim 4, wherein the image destroying apparatus includes a container for holding a liquid.

8. The device of claim 7, wherein the image destroying apparatus includes a cutter for destroying the image.

9. The device of claim 7, wherein the image destroying apparatus includes a rasp for destroying the image.

10. The device of claim 7, wherein the image destroying apparatus includes a perforator for destroying the image.

11. The device of claim 1, wherein the image destroying apparatus completes destruction of the image before the photosensitive material is ejected outside the device.

12. The device of claim 11, wherein the image destroying apparatus employs a chemical process when destroying the image.

13. The device of claim 12, wherein the image destroying apparatus includes a light-flashing apparatus which produces a flash for destroying the image.

14. The device of claim 12, wherein the image destroying apparatus includes a container for holding a liquid.

15. The device of claim 11, wherein the image destroying apparatus employs a physical process when destroying the image.

16. The device of claim 15, wherein the image destroying apparatus includes a cutter for destroying the image.

17. The device of claim 15, wherein the image destroying apparatus includes a rasp for destroying the image.

18. The device of claim 15, wherein the image destroying apparatus includes a perforator for destroying the image.

19. The device of claim 1, wherein said developing apparatus and said image destroying apparatus are disposed within a single housing, and said photosensitive material is passed between said developing apparatus and said image destroying apparatus along a path completely contained internal to said housing.

20. The device of claim 1, wherein said developing apparatus comprises a holding tank for immersing said photosensitive material in a fluid and a heating element.

21. The device of claim 1, wherein the information recording apparatus, when recording the electronic image information, marks the recorded electronic image information for indicating that the information is primary data.

22. The device of claim 21, wherein the information recording apparatus records the image information on a memory medium, and the mark is a flag.

23. A method of processing exposed photosensitive material, comprising the steps of:

producing a visible image by heat-development processing of the exposed photosensitive material;

reading and recording the visible image as image data; and destroying the visible image on the photosensitive material from which the visible image has been read and recorded as image data.

24. The method of claim 23, wherein the steps of producing the visible image and destroying the visible image are completed within a single housing and are not removed from said single housing until both steps are completed.

25. The method of claim 24, wherein the step of destroying the visible image is performed by chemical destruction.

26. The method of claim 25, wherein chemical destruction of the visible image includes at least one of destruction of the visible image by flash illumination and immersing the photosensitive material in a chemical that elutes an image-forming component in the photosensitive material.

27. The method of claim 24, wherein the step of destroying the visible image is performed by physical destruction.

28. The method of claim 27, wherein physical destruction of the visible image includes at least one of destroying the visible image by cutting the photosensitive material, destroying the visible image by shaving a surface of the photosensitive material, and destroying the visible image by forming a plurality of holes in the photosensitive material.

29. The method of claim 24, wherein said heat development processing comprises immersing said photosensitive material in a fluid and disposing said photosensitive material against a heating element.

30. The method of claim 23, wherein said heat development processing comprises immersing said photosensitive material in a fluid and disposing said photosensitive material against a heating element.

31. An image recording device for use with film, comprising:

(a) rollers which rotate and convey film along a path of travel;

(b) a film developer disposed along the path of travel, which receives the film and develops exposures thereon into visible images;

(c) a light source disposed along the path of travel downstream of the film developer, which irradiates the film with light;

(d) an image sensor positioned for receiving light irradiated onto the film, and which produces electronic information corresponding to the light received;

(e) a data processor electronically connected to the image sensor, which receives the electronic information, the data processor having a memory into which the data processor stores data according to the electronic information received; and (f) an image destroyer disposed along the path of travel downstream of the image sensor, which receives the film and destroys visible images on the film.

* * * * *

Adverse Decision In Interference

Patent No. 6,352,379, Kazuo Sanada, DEVELOPING DEVICE AND PHOTOSENSITIVE MATERIAL PROCESSING METHOD, Interference No. 105,029, final judgment adverse to the patentees rendered June 19, 2003, as to claims 1-31.

*(Official Gazette July 29, 2003)*